United States Patent [19]

O'Neill

[11] Patent Number: 4,990,014

[45] Date of Patent: Feb. 5, 1991

[54] CLOSURE ASSEMBLY HAVING A ROTATABLE STEM AND AN AXIALLY MOVABLE APPLICATOR BRUSH

[76] Inventor: Richard K. O'Neill, P.O. Box 2452, Wrightwood, Calif. 92397

[21] Appl. No.: 543,099

[22] Filed: Jun. 25, 1990

[51] Int. Cl.[5] ..... A46B 11/00; A45D 34/04

[52] U.S. Cl. ..... 401/127; 401/129

[58] Field of Search ..... 401/129, 127, 126; 15/172; 132/75, 73

[56] References Cited

U.S. PATENT DOCUMENTS 2,538,447 1/1951 Finney ..... 401/127
3,157,905 11/1964 Levy ..... 401/129 X
4,313,686 2/1982 Proffer ..... 401/127
4,525,090 6/1985 Riley ..... 401/127

*Primary Examiner*—Richard J. Johnson
*Attorney, Agent, or Firm*—Morland C. Fischer

[57] ABSTRACT

A closure assembly to be removably attached across the open neck of a container that contains a supply of fluid. The closure assembly includes an elongated stem which extends into the container and an applicator brush which is attached to the stem so that the fluid within the container may be easily accessed. The closure assembly also includes a cap portion which can be manually rotated so as to impart a corresponding rotation to and axial (i.e. linear) displacement of the stem, whereby to cause the applicator brush to be easily and efficiently lowered into the container in the event of a short fluid supply.

7 Claims, 4 Drawing Sheets

CLOSURE ASSEMBLY HAVING A ROTATABLE STEM AND AN AXIALLY MOVABLE APPLICATOR BRUSH

BACKGROUND OF THE INVENTION

1. FIELD OF THE INVENTION

This invention relates to a closure assembly for a fluid container of the type having a self-contained applicator brush and, more particularly, to means associated with the closure assembly for adjusting the position of the brush within the container in the event of a reduced fluid supply.

2. BACKGROUND ART

It is well known to carry paints, oils, and other fluids within small containers, where access to the fluid is gained by means of a self-contained applicator brush. By removing a closure assembly with which the brush is associated, the liquid may be dispensed from the container, as needed. In the event of a reduced fluid supply, it is frequently necessary to forego use of the brush and tip the container to access the fluid at the bottom thereof. However, such action is known to be inconvenient and/or cause accidental spills. Moreover, either too much or not enough fluid may be poured from the container, depending upon the fluid viscosity.

In my earlier filed patent application Ser. No. 381,977 filed July 19, 1989 and entitled CLOSURE ASSEMBLY HAVING AN AXIALLY MOVABLE LIQUID DISPENSER, a closure assembly was disclosed in association with a fluid container of the type having a self-contained applicator brush. A non-rotatable stem is interconnected at one end thereof with the closure assembly and at the opposite end with the applicator brush. Means are also provided to cause an axial shift in the position of the non-rotatable stem to thereby lower the applicator brush into the container in the event of a short fluid supply.

The instant invention is an improvement of my earlier disclosed invention, whereby the position of a self-contained applicator brush can now be efficiently changed relative to a fluid container by way of a rotatable and axially (i.e. linearly) shifting stem. In this manner, the position of the applicator brush may be more easily adjusted to access fluid in the container while requiring less effort (i.e. no wasted motion) and time consumption on the part of the user.

SUMMARY OF THE INVENTION

In general terms, a closure assembly is disclosed to be removably connected to a container of the type having a self-contained applicator brush by which to access a supply of fluid within the container. The closure assembly includes a lower body that is mated to the container at the neck thereof and an to the body. Extending from and rotatable with the cap of the, closure assembly is a pair of motion transferring forks which are arranged in spaced, face-to-face alignment with one another. One end of an elongated stem is received between the forks, and the opposite end of the stem, at which the applicator brush is retained, extends into the container. A pair of thread segments extend radially outward from the stem. An internally threaded sleeve surrounds the forks and the stem, such that the thread segments of the stem project through the spaces between the forks to communicate with the threads of the sleeve.

In operation, the upper cap of the closure assembly is manually rotated relative to the lower body. The rotation of the cap is transferred to the stem by way of the forks and the thread segments of the stem which are engaged by and rotated with said forks. Accordingly, the stem will be simultaneously rotated and axially displaced, inasmuch as the thread segments of the stem ride along the threads of the sleeve. Likewise, the applicator brush attached to the stem will be relocated through the container so as to easily gain access to fluid which is in short supply therewithin. By virtue of the present invention, the user may efficiently adjust the location of the brush relative to the container with a minimal waste of motion and loss of time.

DESCRIPTION OF THE PREFERRED EMBODIMENT

Figure 1:
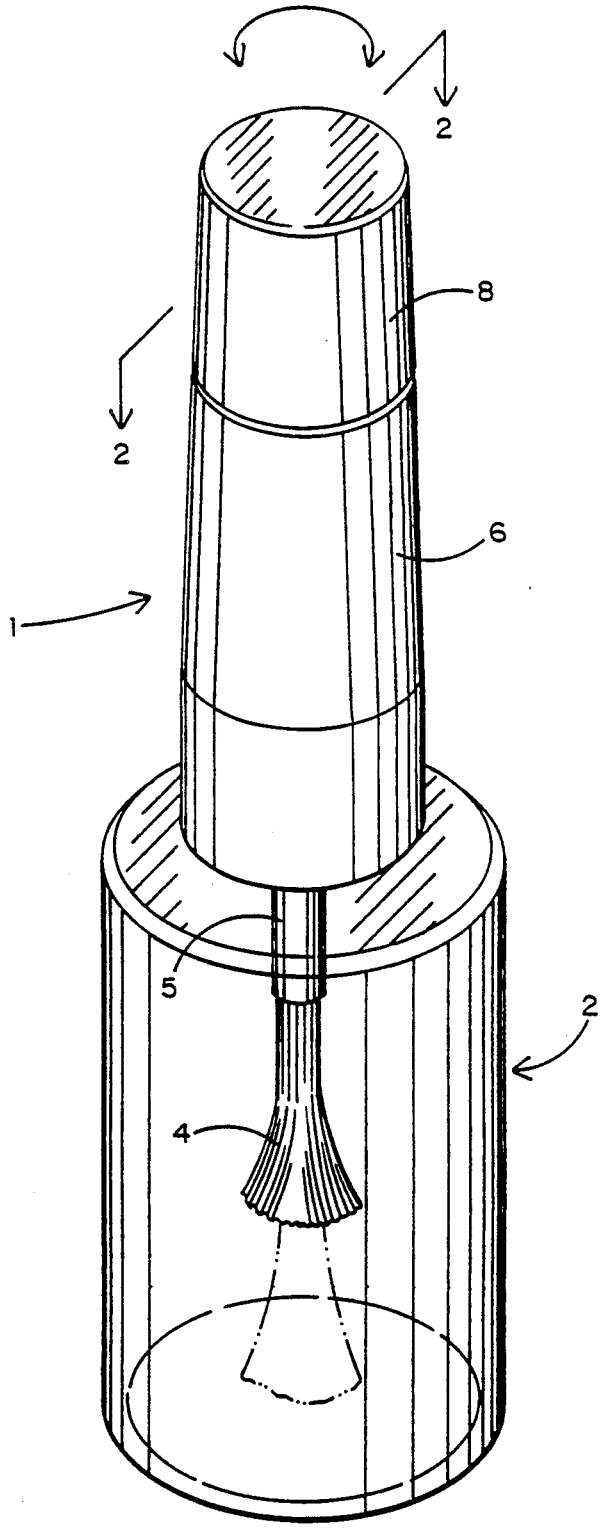
FIG. 1 is a perspective view of a fluid container to which the closure assembly that forms the present invention is removably attached.

Referring to FIG. 1 of the drawings, the closure assembly 1 which forms the present invention is shown removably connected to a fluid container 2 of the type in which a small self-contained applicator brush 4 is to be located by way of an elongated stem 5. By way of example only, the container 2 with which closure assembly 1 is associated may be filled with nail polish, cuticle oil, paint, and other fluids which are typically removed from the container by an applicator brush. However, the type of fluid with which container 2 is filled is not to be regarded as a limitation of the present invention.

As will be explained in greater detail hereinafter, the closure assembly 1 comprises a lower body portion 6 and an upper cap portion 8. The lower body portion 6 of closure assembly 1 is adapted to be mated to the neck of container 2 (best shown in FIG. 2), while the upper cap portion 8 is interconnected with and rotatable relative to lower body portion 6. As will also be explained, a rotation of the upper cap portion 8 causes a corresponding rotation of the stem 5 and an axial (i.e. linear) displacement of the brush 4 thereof (shown in phantom) within container 2. In this manner, and with closure assembly attached to container 2, a user will be able to readily and efficiently adjust the position of brush 4 through container 2, so as to easily gain access to a short supply of fluid without having to tip the container and risk a possible spill, as is otherwise common to conventional containers in which a fluid is in short supply. What is more, the user will be better able to reach the fluid in the container after the closure assembly 1 has been removed therefrom.

Figure 2:
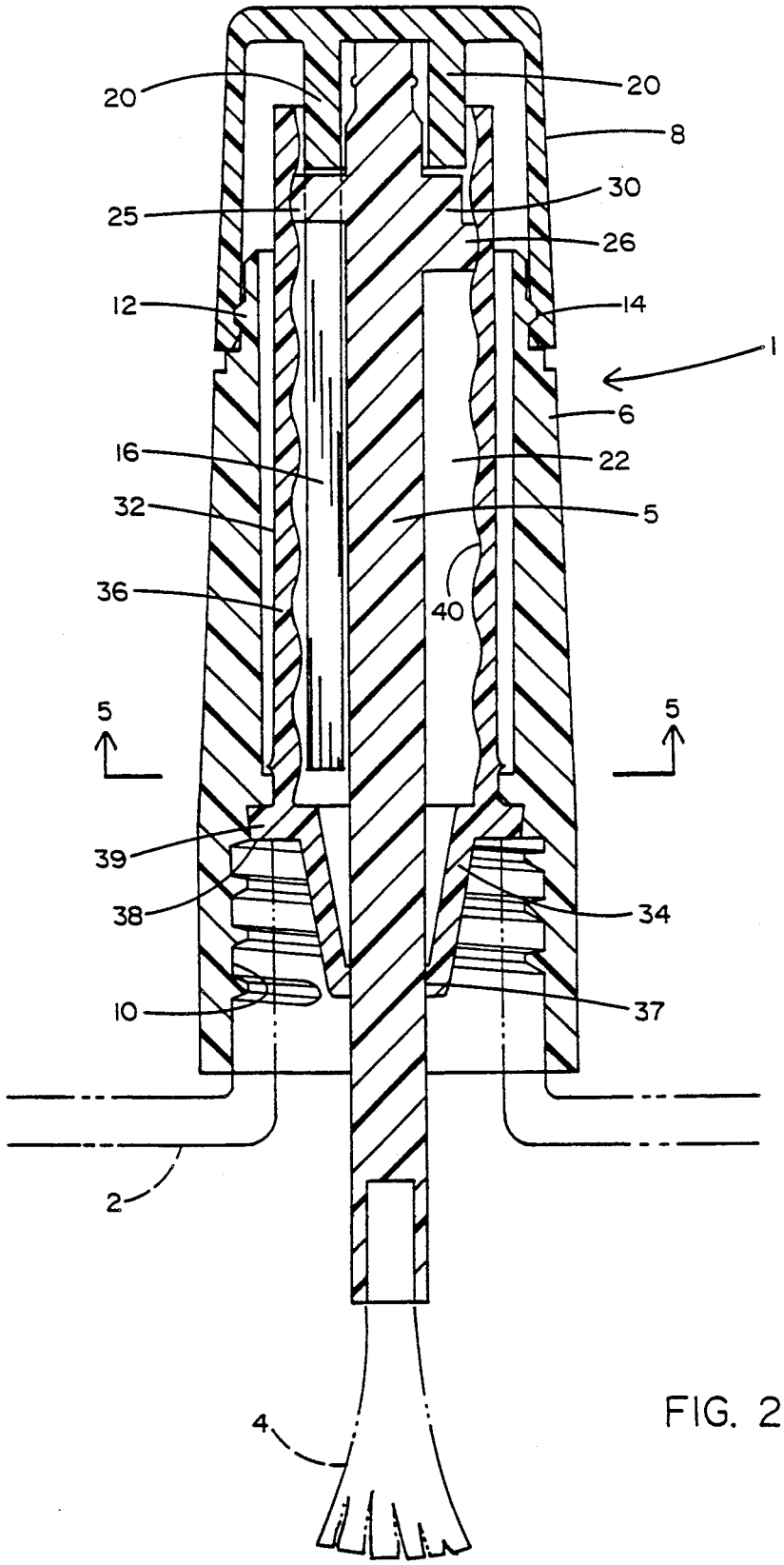
FIG. 2 is a cross-section taken along lines 2—2 of FIG. 1.
Figure 4:
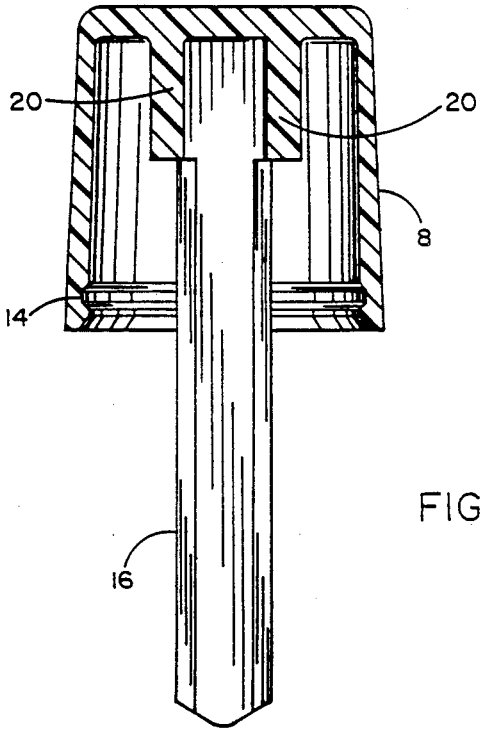
FIG. 4 is a cross-section taken along lines 4—4 of FIG. 3.
Figure 3:
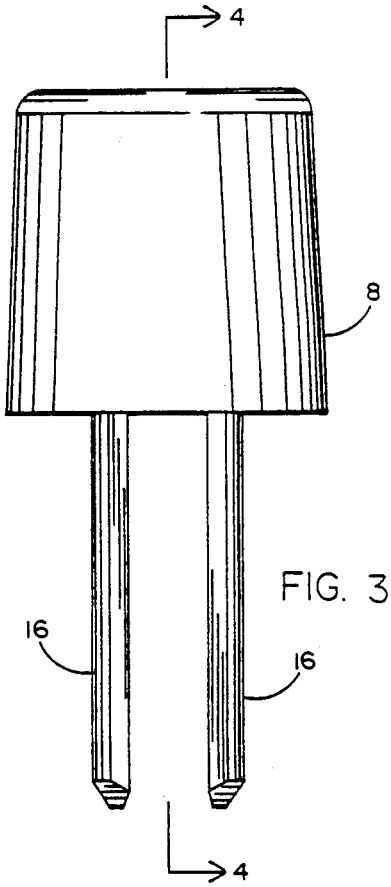
FIG. 3 is a side elevation of an upper cap portion which forms a part of the closure assembly of FIG. 1.
Figure 5:
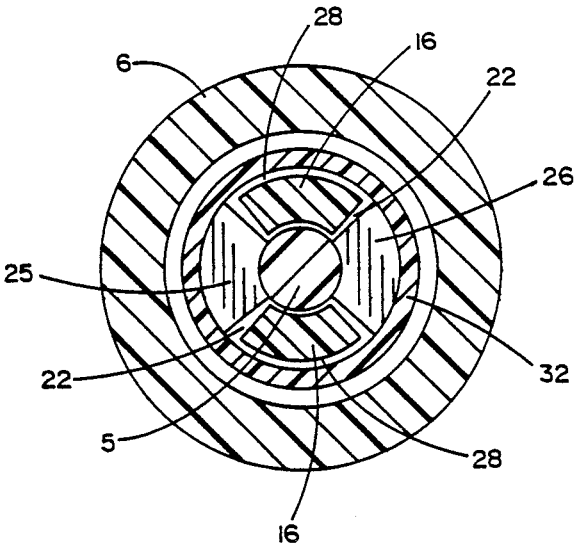
FIG. 5 is a cross-section taken along lines 5—5 of FIG. 1.

The details of the closure assembly 1 and the means by which a rotation of the cap portion 8 relative to the body portion 6 causes a corresponding rotation of stem 5 and an axial displacement of brush 4 are discussed while referring initially to FIG. 2 of drawings. The lower body portion 6 of closure assembly 1 is shown having a series of internal screw threads 10 extending therearound. The screw threads 10 enable the body portion 6 to be mated to (or detached from) the container 2 (shown in phantom) at a corresponding set of screw threads formed around the neck thereof. A locking ring 12 is integrally formed (e.g. molded) around the periphery of lower body portion 6, and a correspondingly sized locking groove 14 (best shown in FIG. 3) is formed around the upper cap portion 8. In the assembled relationship, the locking ring 12 is snap fit and slidably received within the locking groove 14, whereby cap portion 8 is interconnected and rotatable relative to body portion 6, as was previously disclosed.

Referring concurrently to FIGS. 2–5 of the drawings, a pair of elongated, concave shaped forks 16 are shown coextensively formed with and projecting downwardly from opposite sides of a hollow, cup-shaped hub 20. Hub 20 is molded between the forks 16 and the inside top of cap portion 8 to lend axial support to the forks. The concave forks 16 are arranged in spaced, face-to-face alignment with one another (best shown in FIG. 3). The hub 20 is shorter than the forks 16, such that circumferentially extending gaps 22 (best shown in FIGS. 2 and 5) are established above the hub 20 and between adjacent edges of the forks.

Figure 6:
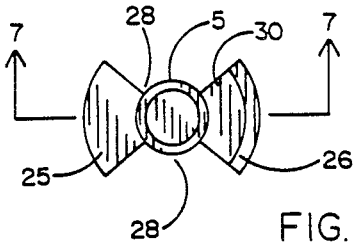
FIG. 6 is a top view of an elongated stem which is interfaced with the closure assembly of FIG. 1 for adjusting the position of an applicator brush.
Figure 7:
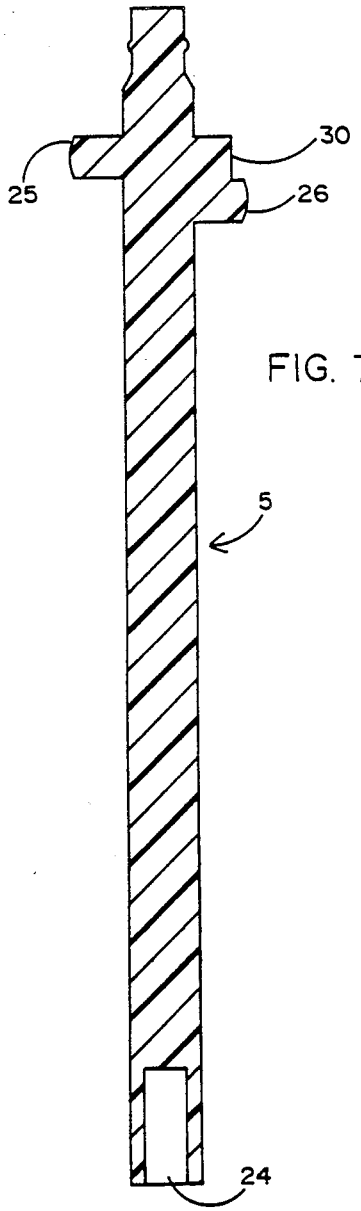
FIG. 7 is a cross-section taken along lines 7—7 of FIG. 6.

In the assembled relationship (of FIG. 2), the elongated stem 5, to which the applicator brush 4 is attached, is received within the hollow hub 20 and between the opposing pair of forks 16. As is best shown in FIGS. 6 and 7, the stem 5 includes a bristle cavity 24 formed at the lower end thereof in which to retain the applicator brush 4) and a pair of relatively narrow thread segments 25 and 26 which project radially outward and in opposite directions from the top of said stem. The function of thread segments 25 and 26 will soon be described. Interspersed between the thread segments 25 and 26 in the circumferential direction is a pair of arcuate notches 28. One of the pair of thread segments (e.g. 25) is located at a higher elevation on stem 5 than the opposing thread segment 26. However, a step 30 is integrally formed atop thread segment 26, such that thread segment 25 and step 30 project from stem 5 at identical elevations therealong. The step 30 is recessed relative to thread segment 26 so as not to interfere with the threaded engagement of stem 5 by a threaded guiding and sealing member 32, as will also soon be described.

With stem 5 supported by hub 20 and located in the space between the respective faces of forks 16 (best shown in FIG. 5), the radially and oppositely projecting thread segments 25 and 26 of stem 5 extend into the respective circumferentially extending gaps 22 that are established between adjacent edges of said forks. Moreover, the concave bodies of forks 16 are received through respective ones of the arcuate notches 28 that are formed between the thread segments 25 and 26 of stem 5. In this manner, any rotation of the upper cap portion 8 relative to the lower body portion 6 of closure assembly 1 is transferred to stem 5 inasmuch as the forks 16 are correspondingly rotated into engagement with the thread segments 25 and 26.

Figure 8:
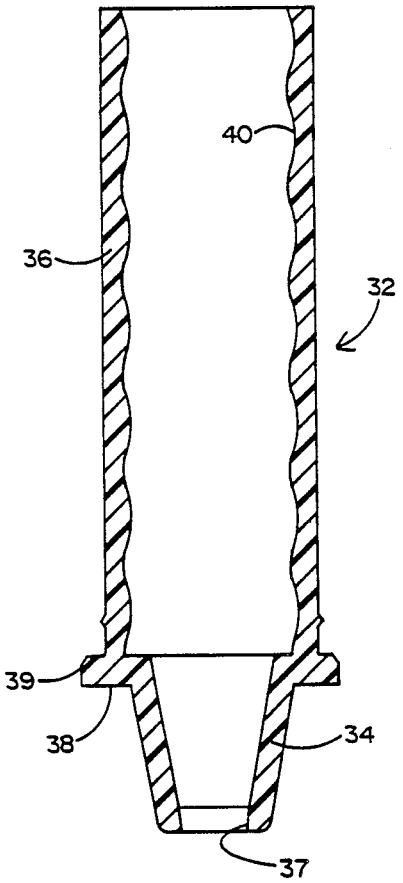
FIG. 8 is a cross-section of a hollow guide and sealing member which forms a part of the closure assembly of FIG. 1.

What is more, any rotation of the upper cap portion 8 causes a corresponding axial displacement of the stem 5 and a relocation of the applicator brush 4 through container 2. More particularly, and as is best shown in FIGS. 2 and 8, a hollow guide and sealing member 32 is retained within closure assembly 1 in surrounding coaxial alignment with stem 5, such that said stem is adapted for both rotational and linear movement relative to member 32. Guide and sealing member 32 includes a conical sealing head 34 that is integrally formed with an elongated, cylindrically shaped and internally threaded sleeve 36. The conical sealing head 34 has a pair of sealing surfaces which form air-tight seals to prevent the fluid in container 2 from drying out prematurely and from leaking up into the closure assembly 1 in the event that said container is tipped. That is, the sealing head 34 engages the stem 5 to form a first, relatively low friction sealing surface 37 thereagainst and prevent leakage as stem 5 rotates and moves linearly through the guide and sealing member 32. Moreover, the sealing surface 37 of sealing head 34 provides axial stability for the stem 5 during the movement thereof. A second sealing surface 38 is created at the interface of the sealing head 34 and the threaded sleeve 36 by means of a disc-like flange 39 which is disposed so as to prevent leakage via the screw threaded connection of closure assembly 1 to the neck of container 2.

The threaded cylindrical sleeve 36 of sealing and guide member 32 includes a right hand spiraled thread 40 that advances axially along the interior thereof. In the assembled relationship of FIG. 2, the radially projecting thread segments 25 and 26 of stem 5 engage the internal threads 40 of sleeve 36, whereby sleeve 36 (together with sealing head 34) provides additional axial stability to stem 5. Thus, the rotation imparted to stem 5 from cap portion 8 (in the manner previously disclosed) will cause thread segments 25 and 26 of stem 5 to ride around the spiraled threads 40 of sleeve 36, whereby said stem will be correspondingly advanced or retracted (depending upon the direction in which cap portion 8 is rotated) through the hollow guide and sealing member 32. Likewise, the position of the applicator brush 4 at the end of stem 5 will be reliably adjusted relative to container 2 so as to be moved either closer to or in contact with the remaining fluid in the container.

Hence, and by virtue of the present invention, it should be recognized that a rotation of the cap portion 8 of closure assembly 1 is efficiently translated into a rotation and linear displacement of the stem 5 to which the applicator brush 4 is attached. Accordingly, there will be little wasted effort and loss of motion on the part of the user when brush 4 is relocated to the position in the container 2 at which fluid is located, so as to avoid the inconvenience and the risk of a spill that are commonly associated with conventional containers in which a self-contained brush is used to gain access to and apply such fluid.

It will be apparent that while a preferred embodiment of the invention has been shown and described, various modifications and changes may be made without departing from the true spirit and scope of the invention. For example, although an applicator brush 4 has been illustrated and described for dispensing a fluid from the container 2, it is to be understood that the closure assembly 1 of this invention may alternatively be interfaced with a swab or any similar fluid applicator.

Having thus set forth a preferred embodiment of the invention, what is claimed is:

1. A closure assembly to be removably connected to the neck of a container in which a fluid supply is located, said closure assembly comprising:

a body to be mated to the neck of the container;

a cap attached to said body and rotatable relative thereto;

motion transferring means projecting from said cap and rotatable therewith;

an elongated stem, a first end of which is received by said cap and the opposite end carrying a fluid applicator and extending into the container to position the applicator in contact with the fluid supply of the container, said stem having thread means projecting outwardly therefrom;

a sleeve coaxially aligned with and surrounding said elongated stem and having axially advancing spiral threads extending therearound, such that the thread means of said stem communicates with the threads of said sleeve, a rotation of said cap causing said motion transferring means to rotate into contact with the thread means of said stem to correspondingly rotate said stem and further cause the thread means of said stem to ride along the threads of said sleeve, whereby said stem and the applicator associated therewith are displaced axially relative to the container; and a hollow sealing head interconnected with said sleeve and surrounding said stem in engagement therewith to permit the rotation and axial displacement of said stem, said sealing head having a sealing surface located at the interface of said sealing head with said stem to prevent the leakage of fluid therepast.

2. The closure assembly recited in claim 1, wherein said sealing head is connected to said sleeve at the interior of said closure assembly, said sealing head having an additional sealing surface located at the interface of said sealing head with said sleeve to block the leakage of fluid therepast.

3. A closure assembly to be removably connected to the neck of a container in which a fluid supply is located, said closure assembly comprising:

a body to be mated to the neck of the container;

a cap interconnected with said body and rotatable relative thereto;

an elongated stem carrying a fluid applicator and extending from said cap into the container to position the fluid applicator in contact with the fluid supply of the container, said stem having thread means projecting therefrom;

motion transferring means including at least one pair of concave arms that project from said cap and are rotatable therewith, said concave arms being arranged with one another in spaced, face-to-face alignment so that circumferentially extending gaps are established between adjacent edges of said arms, said stem being received within the space between the faces of said arms and the thread means of said stem extending into said gaps so as to be engaged and rotated by said arms when said arms are rotated with said cap; and a sleeve surrounding said elongated stem and having axially advancing threads extending therearound, such that the thread means of said stem communicates with the threads of said sleeve, a rotation of said cap causing the arms of said motion transferring means to rotate into contact with the thread means of said stem to correspondingly rotate said stem and further cause the thread means of said stem to ride along the axially advancing threads of said sleeve, whereby said stem and the applicator carried thereby are displaced axially relative to the container.

4. A closure assembly to be removably connected to a container in which a supply of fluid is located, said closure assembly comprising:

a body to be mated to the neck of the container;

a cap attached to said body and rotatable relating thereto an elongated stem carrying a fluid applicator and adapted to be moved longitudinally into the container to position the fluid applicator in contact with the fluid supply of the container, said stem having a plurality of threads extending radially outward therefrom and spaced from one another around the periphery of said stem;

motion transferring means projecting from and rotatable with said cap, said motion transferring means including a plurality of longitudinally extending arms that are received within respective spaces between adjacent radially extending threads of said stem; and a hollow sleeve positioned inwardly of said body and surrounding said elongated stem, said sleeve having means at one end thereof for engaging and supporting said stem for longitudinal movement relative to the container and having longitudinally advancing threads extending around the opposite end thereof, such that the plurality of radially extending threads of said stem communicate with the threads of said sleeve, a rotation of said cap causing the plurality of arms of said motion transferring means to rotate into contact with respective ones of the plurality of threads of said stem to correspondingly cause said stem to rotate and further cause the threads of said stem to ride along the longitudinally advancing threads of said sleeve, so that said stem and the applicator carried thereby are displaced longitudinally relative to the container.

5. The closure assembly recited in claim 4, further comprising a hollow fluid sealing head connected to the first end of said sleeve to surround and engage said stem and support said stem for longitudinal movement relative to the container, said sealing head having a first sealing surface located at the interface of said sealing head with said stem to block the leakage of fluid therepast.

6. The closure assembly recited in claim 5, wherein said sealing head is connected to said hollow sleeve at the interior of said closure assembly, said sealing head having an additional sealing surface located at the interface of said sealing head with said sleeve to block the leakage of fluid therepast.

7. The closure assembly recited in claim 4, wherein said stem includes at least one pair of radially extending threads and said motion transferring means includes at least one pair of longitudinally extending arms, said pair of arms comprising concave forks that are arranged in spaced face-to-face alignment so that circumferentially extending gaps are formed between adjacent edges of said forks, said stem being received within the space between the faces of said forks and each of the pair of threads of said stem extending into a respective circumferentially extending gap between the adjacent edges of said forks to be engaged by and rotated with said forks when said forks are rotated by said cap.

* * * * *